United States Patent [19]

Hawley et al.

[11] Patent Number: 4,893,544

[45] **Date of Patent: * Jan. 16, 1990**

[54] FLASH SUPPRESSOR

[75] Inventors: Mark R. Hawley, Kennewick, Wash.; Gerald B. Lucas, Lakeside, Mont.

[73] Assignee: D. C. Brennan Firearms, Inc., Cincinnati, Ohio

[ * ] Notice: The portion of the term of this patent subsequent to May 12, 2004 has been disclaimed.

[21] Appl. No.: 245,977

[22] Filed: Sep. 19, 1988

Related U.S. Application Data

[63] Continuation of Ser. No. 33,518, Apr. 1, 1987, abandoned, which is a continuation of Ser. No. 642,784, Aug. 21, 1984, Pat. No. 4,664,014.

[51] Int. Cl.[4] ..... F41C 21/18

[52] U.S. Cl. ..... 89/14.2

[58] Field of Search ..... 42/79; 89/14.2, 14.3, 89/14.4, 14.5

[56] References Cited

U.S. PATENT DOCUMENTS

| | | | |
|---|---|---|---|
| 1,462,158 | 7/1923 | Wildner | 89/14.4 |
| 2,662,326 | 12/1953 | Powell | 42/79 |
| 2,870,679 | 11/1958 | Collins | 89/14.2 |
| 2,900,875 | 8/1959 | Fergus et al. | 89/14.3 |
| 2,953,972 | 9/1960 | Sorensen | 89/14.3 |
| 3,179,011 | 4/1965 | Rahm | 89/14.3 |
| 3,329,063 | 7/1967 | Ehrenburg et al. | 42/70 |
| 3,455,203 | 7/1969 | Pillersdorf | 89/14.3 |
| 3,710,683 | 1/1973 | Kaltmann | 89/14.2 |
| 3,971,285 | 7/1976 | Ellis et al. | 89/14.3 |
| 4,057,003 | 11/1977 | Atchisson | 89/14.3 |
| 4,436,017 | 3/1984 | Mohlin | 89/14.3 |
| 4,570,529 | 2/1986 | A'Costa | 89/14.2 |
| 4,583,445 | 4/1986 | Blair | 89/14.2 |
| 4,664,014 | 5/1987 | Hawley et al. | 89/14.2 |

FOREIGN PATENT DOCUMENTS

| | | | |
|---|---|---|---|
| 633617 | 6/1963 | Belgium | 89/14.2 |
| 2332371 | 1/1975 | Fed. Rep. of Germany | 89/14.5 |
| 911049 | 6/1946 | France | 89/14.2 |

OTHER PUBLICATIONS

Edward C. Ezell, Small Arms of the World, 1977, pp. 555, 565.

Webster's New World Dictionary of the American Language College Edition, 1957, p. 1427.

*Primary Examiner*—Stephen C. Bentley

*Attorney, Agent, or Firm*—Wood, Herron & Evans

[57] ABSTRACT

The inventive device is composed of a cylindrical body with a specifically shaped expanding inner bore which is mounted on the barrel of the firearm. This expanding bore constantly increases from the interface with the muzzle of the firearm to the exit plane of the device. Longitudinal slots, parallel to the bore axis, are cut through the body of the device from the outside to the inner bore.

9 Claims, 2 Drawing Sheets

FLASH SUPPRESSOR

This application is a continuation of application Ser. No. 033,518, filed Apr. 1, 1987, now abandoned, which is a continuation of application Ser. No. 642,784, filed Aug. 21, 1984, now U.S. Pat. No. 4,664,014.

BACKGROUND OF THE INVENTION

This invention relates to flash suppression devices for firearm muzzles.

When a firearm is discharged, the propellant gases that were generated by the combustion of the propellant powder exit the muzzle in the wake of the projectile. This instantaneous discharge of hot propellant gas mixes vigorously with the ambient atmosphere, and certain chemical moieties in the propellant gases have a propensity to ignite by combining with atmospheric oxygen and producing a reaction which results in the release of a certain amount of energy. This energy release is accompanied by an increase in muzzle blast and the emittance of visible light. In conditions of low ambient light, e.g., at night, this flash not only discloses the location of the firer, but also destroys his night vision, especially if his eyesight had been accommodated to low light level prior to the discharge.

The jet of propellant gases also contributes materially to the recoil of the firearm, as the momentum of both projectile and propellant is imparted to the firearm. Because the velocity of the propellant gas jet is typically much higher than that of the projectile, the powder gases contribute a large fraction of the recoil energy to the firearm.

Prior art has repeatedly addressed the management of the energy of the escaping propellant gases. It has long been the practice for both small arms and cannon to equip the barrel with a muzzle brake which diverts part of the propellant gases rearward or at right angles to the muzzle exit, thus eliminating that portion of the recoil. Small arms, particularly assault rifles, submachine guns, and machine guns, are ordinarily equipped with muzzle devices intended to suppress the flash which would usually be expected upon discharge. On occasion, muzzle devices having the dual purpose of reducing both flash and recoil are fitted.

In the prior art, flash suppression has been sought in three different ways: (1) Chemical constituents are incorporated into the propellant powder so that the reaction between the powder gases and atmospheric oxygen is impeded; (2) A shroud is fitted to the muzzle to simply hide the flash; and (3) The powder gases are vented in such a way as to mix them with the atmosphere so that the conditions to initiate and support combustion are not attained. Method (1) is independent of the firearm, and most modern propellants incorporate a flash suppression additive.

In contrast, recoil reduction has always been addressed from the single approach of diverting the powder gases so that a smaller component of the recoil force is along the axis of the barrel.

It is an objective of this invention to eliminate the visible flash from the muzzle of a firearm when discharged in an environment of low ambient illumination. It is an additional objective to reduce the perceived recoil of weapons that incorporate this device, so that the effectiveness of the weapon is improved, as well as its controllability, in fully automatic fire.

It is another objective to accomplish this with a muzzle device which is similar in weight and bulk to those in contemporary usage.

SUMMARY OF THE INVENTION

The purpose of the expanding inner bore in the device is to present greatly varying wall pressure to the longitudinal slots, which are cut through the body of the device from its Exit Plane and communicate between the inner bore and the outside of the device. These slots, by regulating the venting of powder gases laterally out of the device, (1) break up and interfere with the formation of the otherwise symmetrical structure of the "shock bottle", and (2) create multiple reflections of the shock waves in the emerging propellant gases. These propellant gases are then presented to the atmosphere at an increased volume and a lower pressure. Conditions are thus created that when the gases are mixed with the atmospheric air, the temperatures are such that ignition cannot occur.

The processes by which the powder gases are introduced and mixed are essentially different from the processes taught by the prior art or the processes that occur when no muzzle device is fitted to the barrel.

THE DRAWINGS

FIG. 1 is a perspective view of the flash suppressor of the invention showing it attached to a barrel of a gun;

FIG. 2, a side elevational view of one embodiment of the flash suppressor;

FIG. 3, a side elevational sectional view of an embodiment of the flash suppressor;

FIG. 4, a side elevational sectional view of another embodiment of the flash suppressor;

FIG. 5, a side elevational sectional view of another embodiment of the flash suppressor;

FIG. 6, a side elevational sectional view of another embodiment of the flash suppressor;

FIG. 7, a side elevational sectional view of another embodiment of the flash suppressor;

FIG. 8, a side elevational sectional view of another embodiment of the flash suppressor;

FIG. 9, an end elevational view of an embodiment of the flash suppressor;

FIG. 10, an end elevational view of another embodiment of the flash suppressor;

FIG. 11, an end elevational view of another embodiment of the flash suppressor;

FIG. 12, an end elevational view of another embodiment of the flash suppressor;

FIG. 13, an end elevational view of another embodiment of the flash suppressor;

FIG. 14, an end elevational view of another embodiment of the flash suppressor.

DETAILED DESCRIPTION OF THE PREFERRED EMBODIMENTS

Referring to the drawings, as illustrated in FIGS. 1 and 2, an exit bore flash suppressor 1 of the invention is attached to the barrel 2 of a firearm by means of a threaded connection 3. A plurality of slots 4 extend from the barrel muzzle to the exit plane 5 of exit bore device 1. These slots total at least two, are parallel to the axis of the bore, and are preferably 6–9 times caliber length.

The exit bore device 1 reduces and eliminates flash by a combination of these two major parameters: the contour of the inner bore and the number, size and placement of the slots. The internal geometry of the exit bore device 1 is best illustrated by longitudinal section views (FIGS. 3, 4, 5, 6, 7, 8) and the slots are best shown by end views (FIGS. 9, 10, 11, 12, 13, 14).

FIGS. 3–8 depict several acceptable geometries of the inner bore 6. The devices have a threaded section 3 for attachment to a gun barrel 2 or a smooth bore. FIG. 3 shows an attachment whereby the base of the device 1 butts firmly against the muzzle 7. If the threads of the device and muzzle are not synchronized for the preferred slot orientation, the device must be rotated to accomplish this. FIG. 4 illustrates this case, and the gap 8 that results. It has been found that this has negligible effect on flash.

The device depicted in FIG. 3 approximates the optimal inner geometry of the exit bore device 1. Exit bore device 1 begins with a short cylindrical section 9 of approximately ½ caliber in length with an A/A* of 1.6. A/A* is defined as the area of the inner bore at a specific point divided by the area of the barrel bore. This short initial section 9 regulates the nature of the flash and is beneficial on some exit bores devices, dependent upon slot width and barrel length. However, it is not essential and has been omitted from FIGS. 5 and 6.

The main cylindrical section 10 follows next which can have an A/A* ratio from 2 to 4, but preferably about 2.6. A tapered section also known as an exit bore tapered section then extends to the exit plane 5 of the device. This exit bore tapered section preferably has a A/A* ratio of from about 4 to about 14.7 at the outward end. This taper is preferably uniform but can be non-uniform and is from 2 to 10 degrees, preferably from about 6 to about 10 degrees. Seven to nine degrees has been found to be the preferred range of exit bore taper sections with an A/A* at the exit plane of between 7 to 9.5.

The degree of taper and point of origination is important in reducing flash. Varying these dimensions determines wall pressure on the slots, which in turn determines how much gas is allowed to escape through the slots versus how much gas is directed forward. A proper balance must be achieved here. If too much gas escapes through the slots, flash will extend radially around the device. If too much gas is directed forward, a flash will be created in front of the device.

Similarly, the length of the slots determines how much gas is released through the slots versus that portion which is expelled forward. As the length of the slots increase, a greater percentage of the propellant gases exit through the slots, and the pressures in the inner bore decrease. This gradual introduction of these propellant gases to the atmosphere results in the gradual imparting of the momentum of these gases to the weapon and, hence, increased controllability in automatic fire.

FIG. 4 shows essentially the same structure as FIG. 3, except that the exit bore tapered section 11 consists of two intersecting tapers 12. It is further contemplated that a device could work with numerous tapers of increasing degree or a smoothly expanding curve. FIG. 5 illustrates a device with only the one main cylindrical section 10 which then enters into a uniform taper 13 of more gradual degree than illustrated in FIG. 3. FIG. 6 shows a device of even less taper 14 which originates at the muzzle and smoothly increases to the exit plane 5. FIG. 7 shows an exit bore of short cylindrical sections 15 of increasing diameters.

FIG. 8 depicts a device wherein the outer surface 16 of the end of device has a smaller diameter. The purpose here is to communicate from the inner bore to the atmosphere sooner.

FIGS. 9, 10, 11, 12, 13 and 14 illustrate end views of the exit bore devices with varying numbers and placement of slots. The innermost circle 17 represents the first short cylindrical section; the second circuit 18 represents the main cylindrical sectio which then tapers outwardly to the exit plane or exit bore opening 19. The outermost circle 20 delineates the outside cylindrical shell. The slots originate from the main cylindrical section. The slot width may increase until such pont that the slots expand the geometry of the inner bore. It has been found that a slot width which approaches the maximum allowable reduces flash most effectively due to an increased volume of correspondingly lower pressure gases being presented to the atmosphere.

FIG. 9 shows the preferred slot orientation for a four slotted device. The slots 21 are oriented in this fashion to conceal the primary flash that originates at the muzzle from an observer at the same elevation, and to reduce the amount of dust that is raised from the ground. In addition, any smoke from the slots will not obscure the line of sight of the shooter.

Figure 12:
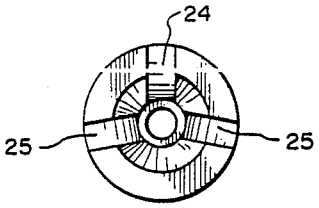
Figure 13:
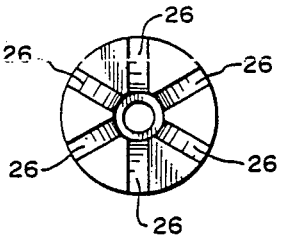

FIG. 12 illustrates the uneven spacing of a three slotted device whereby one slot 24 is oriented in the vertical and the other two 25 are placed approximately 100° from the vertical. This orientation both reduces muzzle climb and flash by introducing even more asymmetry in the shock structure. FIG. 13 shows the even spacing of a six slotted device 26. Due to the multitude of slots, orientation is not important with respect to concealability or dust.

Figure 1:
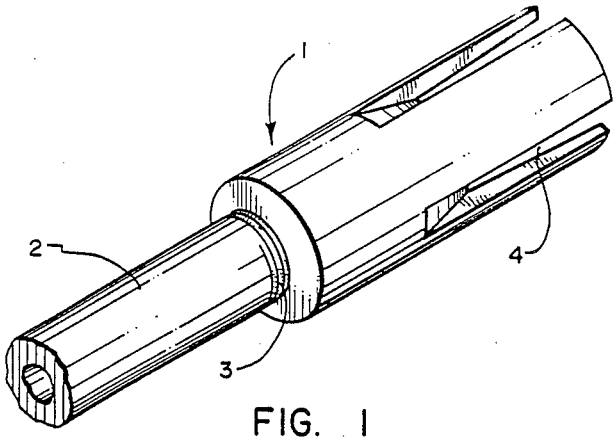
Figure 2:
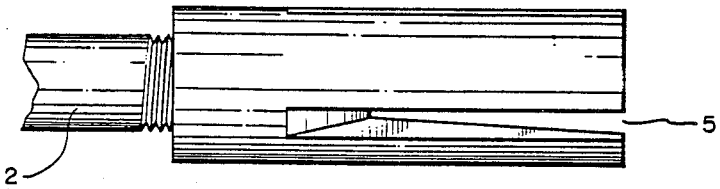
Figure 3:
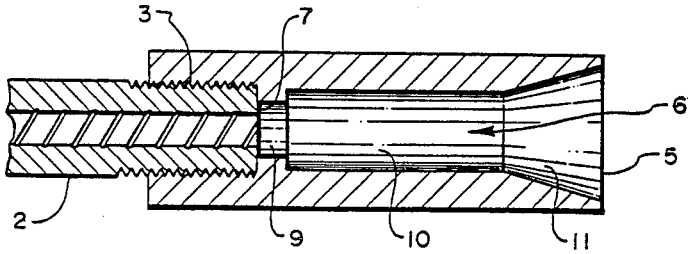
Figure 4:
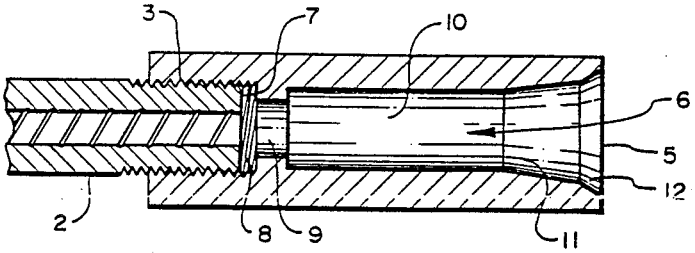
Figure 5:
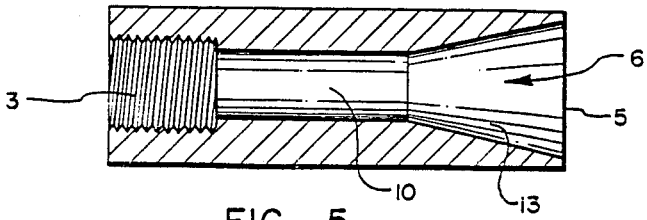
Figure 6:
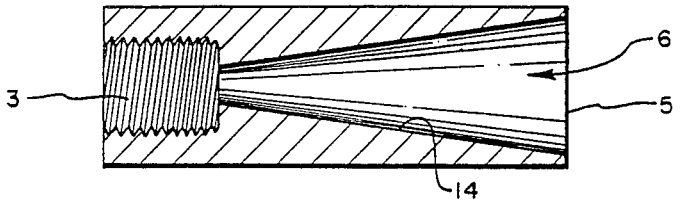
Figure 7:
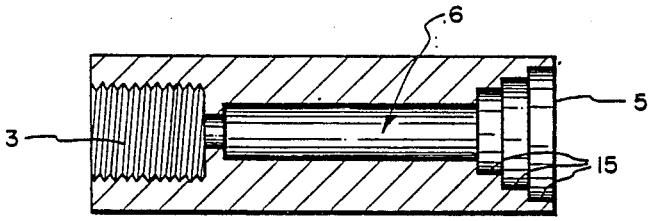
Figure 8:
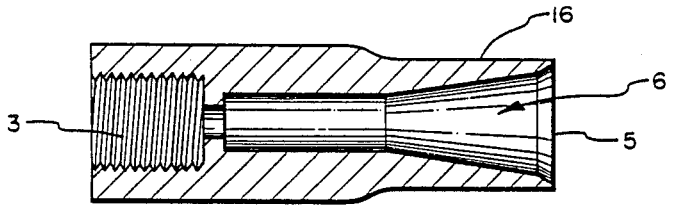
Figure 9:
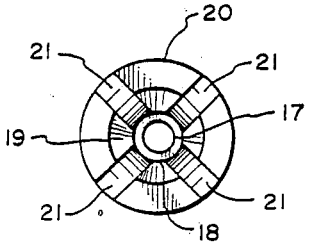
Figure 10:
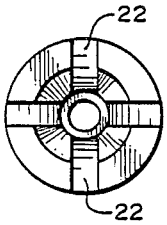
FIG. 10 illustrates an end view of a four slotted device except here, two opposing slots 22 are offset slightly from the centerline bore. The purpose of this arrangement is to change the natural acoustic frequency of the bars and reduce the ringing sound emitted.
Figure 11:
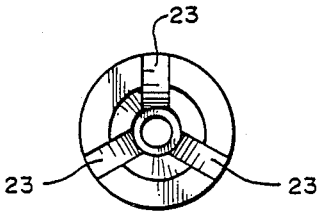
FIG. 11 shows the preferred slot orientation for a three slotted 23 device with 120° spacing. This configuration reduces dust and conceals any primary flash.
Figure 14:
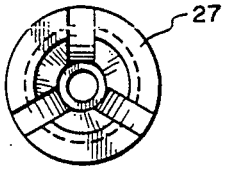

FIG. 14 illustrates an end view of the device shown in FIG. 8. The dotted line 27 represents the smaller diameter of the outside shell of device. The arrangement results in the gases communicating with the atmosphere sooner.

More specifically, the following dimensions are for an exit bore device that has been optimized for the 5.56 MM military rifle cartridge. It is emphasized that these dimensions are not the only combination that will give satisfactory results; there are many such combinations that work well if the elements described above are incorporated. It is also emphasized that different cartridges, barrel lengths, gas regulatory systems, propellants, primers, and/or projectiles may require a different optimized geometry as noted herein.

Example #1
OPTIMUM EXIT BORE

| | |
|---|---|
| Overall length | 2.655 in. |
| Exit bore length | 2.060 in. |
| Thread depth | 0.595 in. |
| Exit Bore diameter | .359 in. |
| Exit Bore taper | 8 degrees |
| Diameter of exit bore opening | 0.610 in. |
| Number of slots | 4 |
| Width of slots | 7/32 in. |

-continued

| Example #1 OPTIMUM EXIT BORE | |
|---|---|
| Total slot width | 7/8 in. |
| 1st cylindrical section | 0.150 in. long<br>0.2812 in. diameter |
| A/A* for main cylindrical section | 2.56 |
| A/A* at exit plane of device | 7.41 |

A/A* is defined in the cross-sectional are of the inner bore at a specific location divided by the cross-sectional area of the barrel bore. Exit bore diameter is the diameter of the main cylindrical section.

However, experimentations have shown the variations around these dimensions have also proven workable. The following table shows the approximate limits of acceptable performance.

TABLE I

| | | Calibers |
|---|---|---|
| Exit bore length | 1.670 to 2.060 | 4.68 to 9.238 |
| Exit bore diameter | 0.348 to 0.391" | .975 to 1.75 |
| Exit bore taper | 2 to 10 degrees | |
| Diameter of exit bore taper | .580 to .680" | 1.62 to 3.05 |
| Number of slots | 3–6 | |
| Width of slots | .1875 to .3125 in | .525 to 1.40 |
| Total slot width | .5625 to 1.125 in | |

More specifically, the following are examples of devices that have proven to be acceptable:

TABLE II

| | 1 | 2 | 3 |
|---|---|---|---|
| Exit bore length | 2.060 in. | 1.860 in. | 1.670 in. |
| Exit bore diameter | .359 in. | .359 in. | .359 in. |
| Exit bore taper | 8° | 8° | 9° |
| Number of slots | 3 | 3 | 3 |
| Width of slots | 3/16–¼in | ¼–5/16 in. | 5/16 in. |
| | 4 | 5 | 6 |
| Exit bore length | 1.860 in. | 1.860 in. | 2.060 in. |
| Exit bore diameter | .359 in. | 0.359 | .359 in. |
| Exit bore taper | 4° | 8° | 2° |
| Number of slots | 3 | 3 | 6 |
| Width of slots | 5/16 in. | 5/16 in. | 3/16 in. |

It is apparent from the above examples that as one deviates from the #1, the optimum #3 bar suppressor, the slot width or total slot width must be increased to produce acceptable results.

Other configurations include devices in which:

(a) said inner bore has, in sequence, an abrupt expansion section to a cylindrical section, a second abrupt expansion section to a cylindrical section and followed by a uniform outward taper to the exit plane of the device;

(b) said inner bore has in sequence an abrupt expansion section to a cylindrical section and then followed by a uniform tapered section to the exit plane of the device;

(c) the first short cylindrical section is less than two calibers in length and has a ratio of approximately 1.6 for the cross-section area of the cylindrical section of the inner bore divided by the cross-sectional area of the barrel bore of the gun barrel;

(d) the outer surface of the outer end of said shell has a reduced diameter from the diameter of the opposite end;

(e) the center of said losts are non-intersecting with the extension of said bore axis;

(f) said slots are from 6 to 10 calibers in length;

(g) the device is made with integral with the barrel;

(h) the slots are unevenly spaced;

(i) the inner bore has a non-uniform taper;

(j) the inner bore comprises a series of cylindrical sections of increasing diameter; and (k) said slots originate ahead of the firearm barrel muzzle.

While this invention has been described and illustrated herein with respect to several preferred embodiments, it is understood that alternative embodiments and substantial equivalents are included within the scope of the invention as defined by the appended claims.

We claim:

1. A device for suppressing flash from the muzzle of a firearm having a defined nozzle bore and said device having a first end, said first end having means to attach to the muzzle of a firearm said device comprising a shell, said shell comprising:

a first opening and an opposite exit plane opening wherein the ratio of the diameter of said exit plane opening to the diameter of said muzzle bore is from 4 to 14.7;

an inner bore extending from said first opening to said exit plane opening;

said inner bore including a first cylindrical section followed by a main cylindrical section and an outwardly expanding tapered section which extends to said exit plane opening;

said tapered section including from 3 to 6 continuous unrestricted axial slots through walls of said tapered section and which extend to said exit plane opening;

said first cylindrical section having a ratio of diameter to muzzle bore diameter of from greater than 1 to less than 2;

said main cylindrical section having a ratio of diameter to muzzle bore diameter of from 2 to 4;

said tapered section having a taper of from 2° to 10°.

2. A device as set forth in claim 1, wherein the outer surface of the outer end of said shell has a reduced diameter from the diameter of the opposite end.

3. A device as set forth in claim 1, wherein said uniform taper is betwen 6 and 10 degrees.

4. A device as set forth in claim 1 wherein the device is made integral with the barrel.

5. A device as set forth in claim 1, wherein the slots are unevenly spaced.

6. A device as set forth in claim 1, wherein the inner bore has a non-uniform taper.

7. A device as set forth in claim 1, wherein the inner bore comprises a series of cylindrical sections of increasing diameter.

8. The device of claim 1 in which said expanding exit bore section has a smooth taper.

9. The flash suppressor claimed in claim 1 wherein each of said slots have a width and wherein the total of said widths is from 1.54 to 3.16 calibers.

* * * * *